US008935821B2

(12) United States Patent
Obriot

(10) Patent No.: US 8,935,821 B2
(45) Date of Patent: Jan. 20, 2015

(54) STRUCTURE FOR SUSPENDED BEDDING

(71) Applicant: Kelly M. Obriot, Grosse Pointe Park, MI (US)

(72) Inventor: Kelly M. Obriot, Grosse Pointe Park, MI (US)

(73) Assignee: Phoenix Design, LLC, Detroit, MI (US)

( * ) Notice: Subject to any disclaimer, the term of this patent is extended or adjusted under 35 U.S.C. 154(b) by 125 days.

(21) Appl. No.: 13/835,361

(22) Filed: Mar. 15, 2013

(65) Prior Publication Data

US 2013/0198957 A1 Aug. 8, 2013

Related U.S. Application Data

(63) Continuation-in-part of application No. 13/496,912, filed as application No. PCT/US2010/049606 on Sep. 21, 2010, now Pat. No. 8,607,390.

(60) Provisional application No. 61/244,194, filed on Sep. 21, 2009.

(51) Int. Cl.

| | |
|---|---|
| ***A47D 7/00*** | (2006.01) |
| ***A47D 7/03*** | (2006.01) |
| ***A47D 15/00*** | (2006.01) |

(52) U.S. Cl.

CPC *A47D 7/007* (2013.01); *A47D 7/00* (2013.01); *A47D 15/001* (2013.01)

USPC ..... 5/724; 5/695; 5/698; 5/652.1; 5/93.1

(58) Field of Classification Search

USPC ..... 5/11, 93.1, 93.2, 97, 98.1, 98.3, 643, 5/652.1, 652.2, 724–726, 423, 606, 695, 5/698

See application file for complete search history.

(56) References Cited

U.S. PATENT DOCUMENTS 1,736,341 A * 11/1929 Eiser ..... 5/695
2,924,832 A * 2/1960 Knowles ..... 5/606

(Continued)

FOREIGN PATENT DOCUMENTS

GB 2310133 A 8/1997
JP 2004283196 A 10/2004

(Continued)

OTHER PUBLICATIONS

International Search Report for Application No. PCT/US2010/049606, mailed Feb. 25, 2011, 2 pages.

(Continued)

*Primary Examiner* — Michael Trettel
(74) *Attorney, Agent, or Firm* — Brooks Kushman P.C.

(57) ABSTRACT

A bedding apparatus may include a frame, a fabric cover, and a liquid containment member. The frame may include first and second members coupled to a base for pivotable motion relative thereto between first and second positions. The base may define an opening surrounded by the first and second members when the first and second members are in the first position. The fabric cover may be coupled to the first and second members and may be maintained in a taught condition by the first and second members when the first and second members are in the first position. The liquid containment member may be disposed below the cover and includes sidewalls and a bottom wall attached to the sidewalls. The sidewalls are attached to the base and extend through the opening. The sidewalls may include a mesh material allowing fluid-flow therethrough. The bottom wall may include a liquid-impermeable material.

20 Claims, 6 Drawing Sheets

(56) References Cited

U.S. PATENT DOCUMENTS

| | | | | |
|---|---|---|---|---|
| 2,963,712 | A | 12/1960 | Cole | |
| 3,403,413 | A * | 10/1968 | Calhoun et al. | 5/638 |
| 3,719,962 | A * | 3/1973 | Burkley | 5/604 |
| 5,561,876 | A | 10/1996 | Petruzella | |
| 5,664,273 | A | 9/1997 | Obriot | |
| 5,699,571 | A * | 12/1997 | Yowell | 5/724 |
| 5,857,232 | A | 1/1999 | Mahdavi | |
| 6,256,813 | B1 * | 7/2001 | Aaron | 5/93.1 |
| 6,370,718 | B1 | 4/2002 | Schmid | |
| 6,425,152 | B1 | 7/2002 | Quarles | |
| 6,438,775 | B1 | 8/2002 | Koenig | |
| 6,560,795 | B2 * | 5/2003 | Hsia | 5/186.1 |
| 6,684,437 | B2 | 2/2004 | Koenig | |
| 6,854,143 | B2 | 2/2005 | Sharples | |
| 7,614,098 | B1 | 11/2009 | Quarry | |
| 8,607,390 | B2 * | 12/2013 | Obriot et al. | 5/724 |
| 8,615,832 | B2 * | 12/2013 | Wang | 5/724 |
| 2007/0061961 | A1 | 3/2007 | Shamie | |
| 2007/0289060 | A1 | 12/2007 | Berkey | |
| 2009/0188048 | A1 | 7/2009 | Shlomo | |
| 2010/0275379 | A1 * | 11/2010 | Streightiff | 5/724 |

FOREIGN PATENT DOCUMENTS

| | | | |
|---|---|---|---|
| KR | 200291207 | Y1 | 10/2002 |
| KR | 200360517 | Y1 | 8/2004 |
| WO | 2008018060 | A2 | 2/2008 |

OTHER PUBLICATIONS

Extended European Search Report for corresponding Application No. 10818008.4, mailed Sep. 12, 2013, 8 pages.

* cited by examiner

STRUCTURE FOR SUSPENDED BEDDING

CROSS-REFERENCE TO RELATED APPLICATIONS

This application is a continuation-in-part of U.S. patent application Ser. No. 13/496,912 filed on Mar. 19, 2012 and now U.S. Pat. No. 8,607,390, which is a 371 United States National Stage of International Application No. PCT/US2010/049606, filed Sep. 21, 2010, which claims priority to United States Provisional Application No. 61/244,194, filed Sep. 21, 2009. The entire disclosures of each of the above applications are incorporated herein by reference.

FIELD

The present disclosure relates to structure for suspended bedding, and more particularly, suspended bedding for use with an infant crib.

BACKGROUND

This section provides background information related to the present disclosure and is not necessarily prior art.

Infants, toddlers, and occasionally small children tend to sleep in cribs. Traditional cribs are often purchased along with a traditional foam or spring mattress in as set. When an infant expels bodily fluids in the crib, these mattresses may become unsanitary, as the bodily fluids may tend to pool or collect around the infant's body. Cleaning these mattresses can be cumbersome and sometimes ineffective, as the bacteria, germs and other matter can become embedded in the mattress. These traditional mattresses can also inhibit the infant's breathing and/or cause the infant to re-breath exhaled carbon dioxide. Furthermore, infants have been known to develop physical deformities as a result of a prolonged contact between a traditional mattress and the infant's skull.

SUMMARY

This section provides a general summary of the disclosure, and is not a comprehensive disclosure of its full scope or all of its features.

In one form, the present disclosure provides a bedding apparatus that may include a frame, a fabric cover, and a liquid containment member. The frame may include first and second members coupled to a base for pivotable motion relative thereto between first and second positions. The base may define an opening at least partially surrounded by the first and second members when the first and second members are in the first position. The fabric cover may be coupled to the first and second members and may be maintained in a taught condition by the first and second members when the first and second members are in the first position. The liquid containment member may be disposed below the cover and may include sidewalls and a bottom wall attached to the sidewalls. The sidewalls may be attached to the base and may extend through the opening. The sidewalls may include a mesh material allowing fluid-flow therethrough. The bottom wall may include a liquid-impermeable material.

In some embodiments, the liquid containment member may include a plurality of eyelets engaging a plurality of hooks extending from sidewalls of the base.

In some embodiments, the cover may include a breathable fabric material allowing fluid-flow therethrough.

In some embodiments, the first and second members and the base may include latch members releasably securing the first and second members in the first position.

In some embodiments, the bedding apparatus may also include a crib skirt including a top portion disposed on the frame and sidewalls hanging down from the top portion.

In some embodiments, the top portion may include first and second panels connected to each other by a zipper.

In some embodiments, the top portion may include a mesh material that allows fluid-flow therethrough.

In some embodiments, the bedding apparatus may include an air-flow path extending through the sidewalls of the liquid containment member, the top portion of the crib skirt, and the cover.

In some embodiments, a periphery of the cover may include a resiliently compressible cushioned trim.

In some embodiments, the cover may be in a slack condition when at least one of the first and second members is in the second position.

In some embodiments, the liquid containment member may form a receptacle for bodily fluids transmitted through the cover.

In some embodiments, the frame may be mounted to and disposed within a crib.

In some embodiments, the base may be attached to a rail member of the crib by a plurality of movable linkages.

In another form, the present disclosure provides a bedding apparatus that may include a crib, a frame, a fabric cover, and a liquid containment member. The frame may be mounted within the crib and may include a base defining an opening. The fabric cover may be coupled to the frame and may be maintained in a taught condition by the frame. The liquid containment member may be disposed below the cover and may include sidewalls and a bottom wall attached to the sidewalls. The sidewalls may be attached to the base and may extend through the opening. The sidewalls may include a mesh material allowing fluid-flow therethrough. The bottom wall may include a liquid-impermeable material. The liquid containment member may form a receptacle for bodily fluids transmitted through the cover.

In some embodiments, the frame may include first and second members coupled to the base for pivotable motion relative thereto between first and second positions. The first and second members surrounding the opening when the first and second members are in the first position. The cover may be maintained in the taught condition by the first and second members when the first and second members are in the first position. The cover may be maintained in a slack condition when the first and second members are in the second position.

In some embodiments, the liquid containment member may include a plurality of eyelets engaging a plurality of hooks extending from sidewalls of the base.

In some embodiments, the cover may include a breathable fabric material allowing fluid-flow therethrough.

In some embodiments, the bedding apparatus may include a crib skirt including a top portion disposed on the frame and sidewalls hanging down from the top portion.

In some embodiments, the top portion may include a mesh material that allows fluid-flow therethrough. An air-flow path may extend through the sidewalls of the liquid containment member, the top portion of the crib skirt, and the cover.

In some embodiments, the base may be attached to a rail member of the crib by a plurality of movable linkages.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
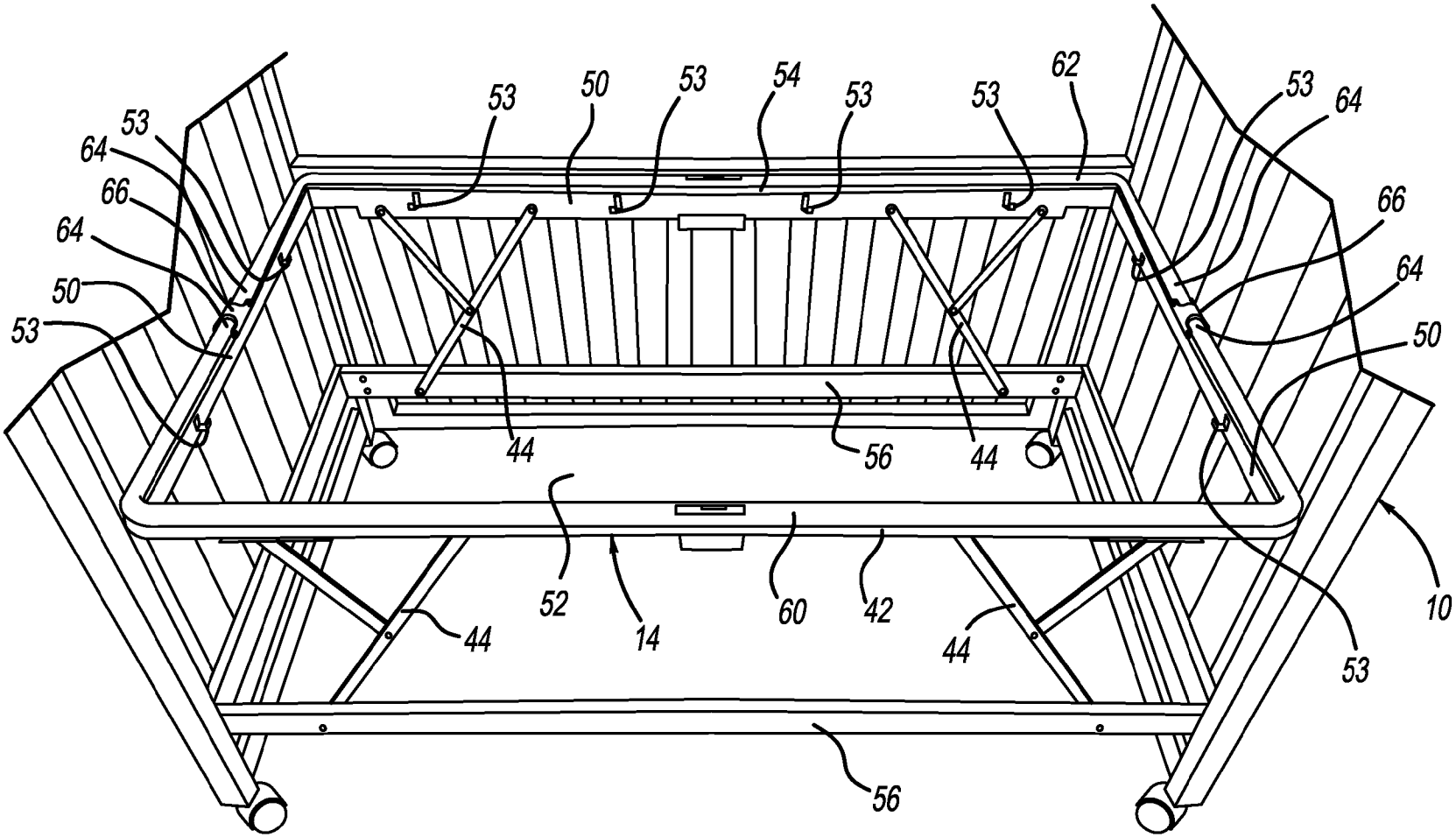
FIG. 1 is a perspective view of a crib having a bedding frame for a suspended bedding apparatus according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
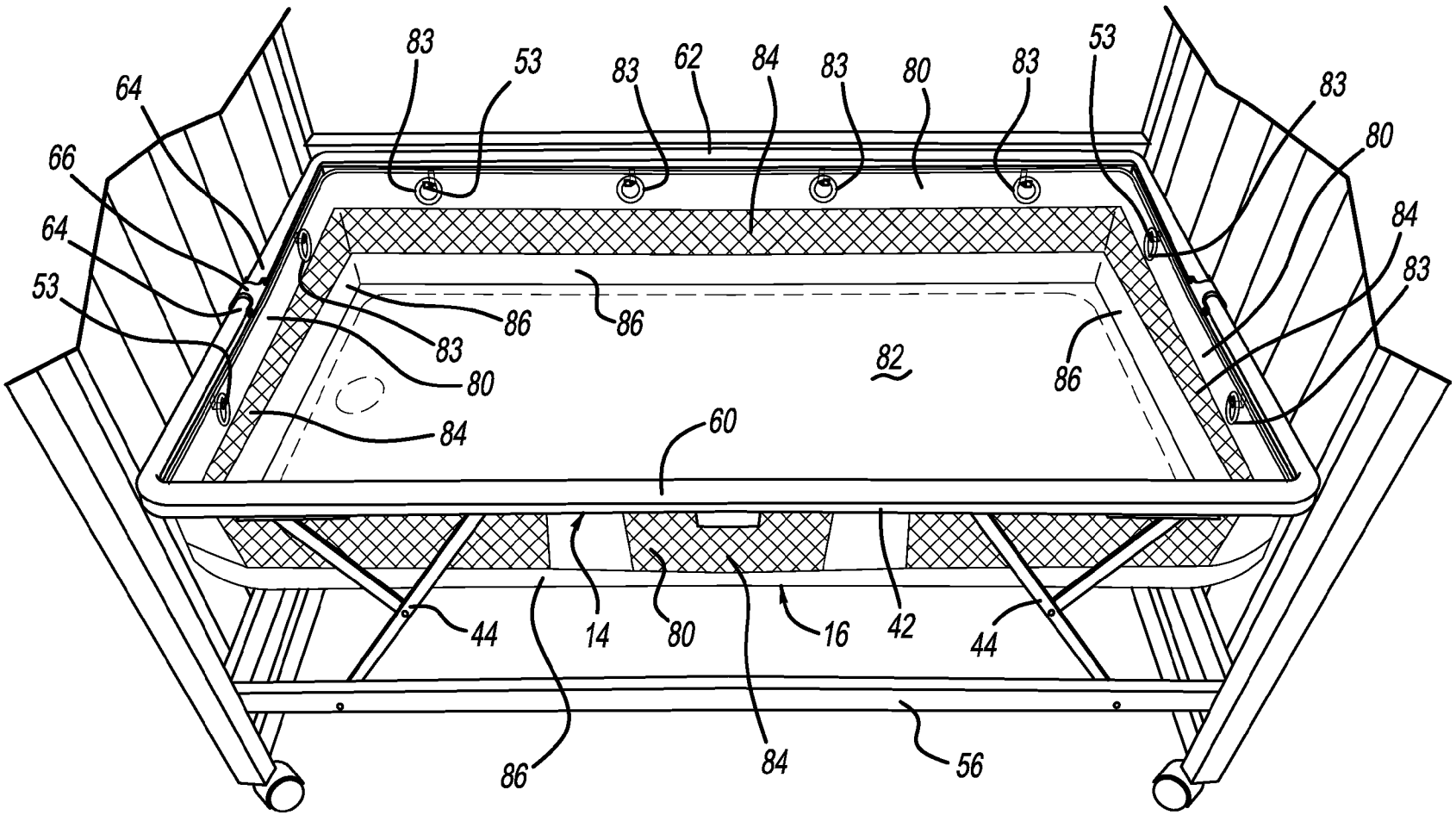
FIG. 2 is a partial perspective view of the crib and bedding frame of FIG. 1 with a liquid containment member attached to the frame.
Figure 3:
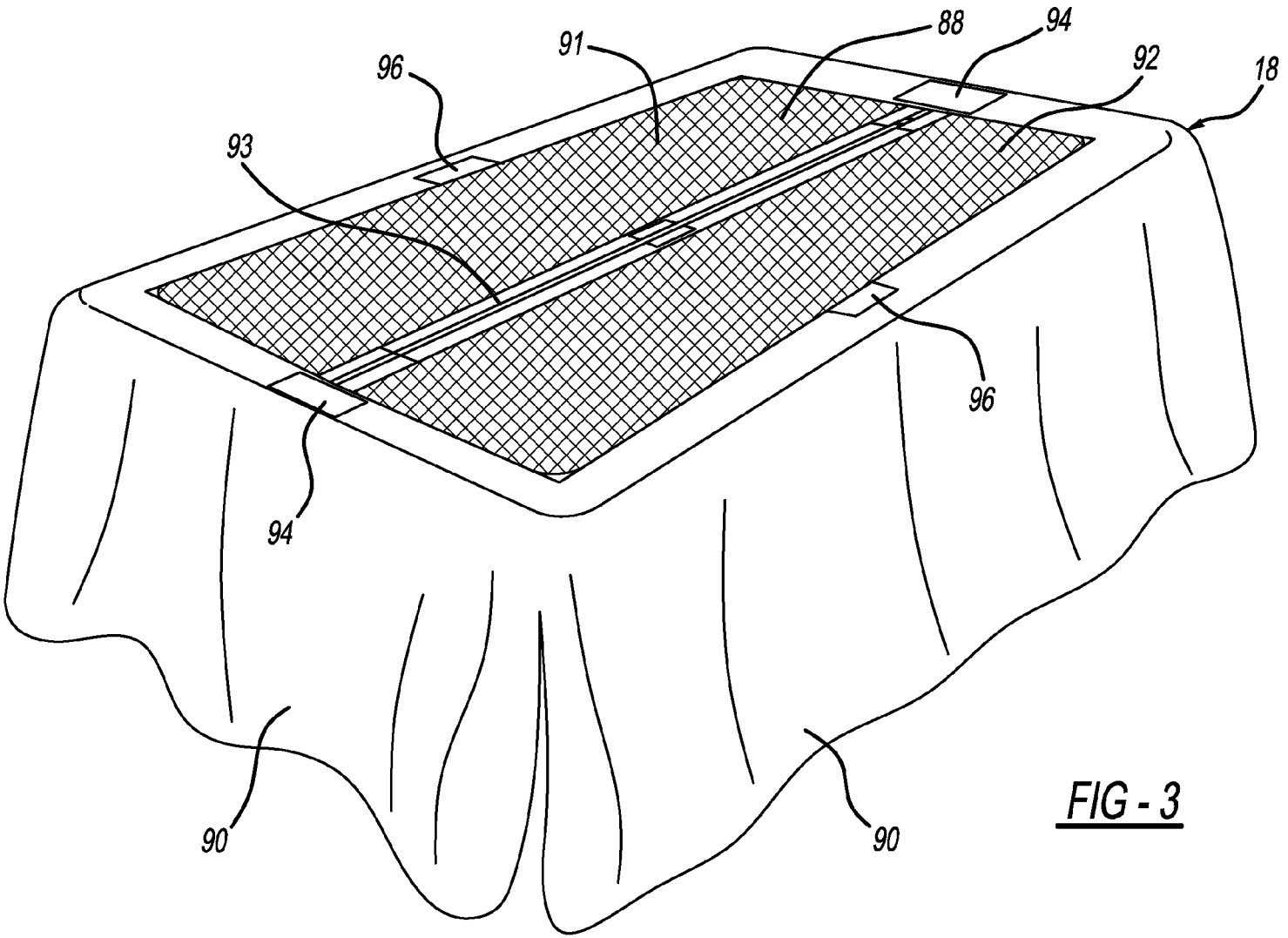
FIG. 3 is a perspective view of a crib skirt for use with the crib and bedding frame.

With reference to FIGS. 1-5, a crib 10 is provided that may include a bedding apparatus having a cover 12 (FIGS. 5 and 6), a bedding frame 14 (FIG. 1), a liquid containment member 16 (FIG. 2), and a crib skirt 18 (FIG. 3). The bedding apparatus may be suitable for use by babies, infants, toddlers, and/or young children (hereinafter collectively referred to as "children"), for example. The crib 10 may be a traditional crib, for example, or any other type of crib.

Figure 5:
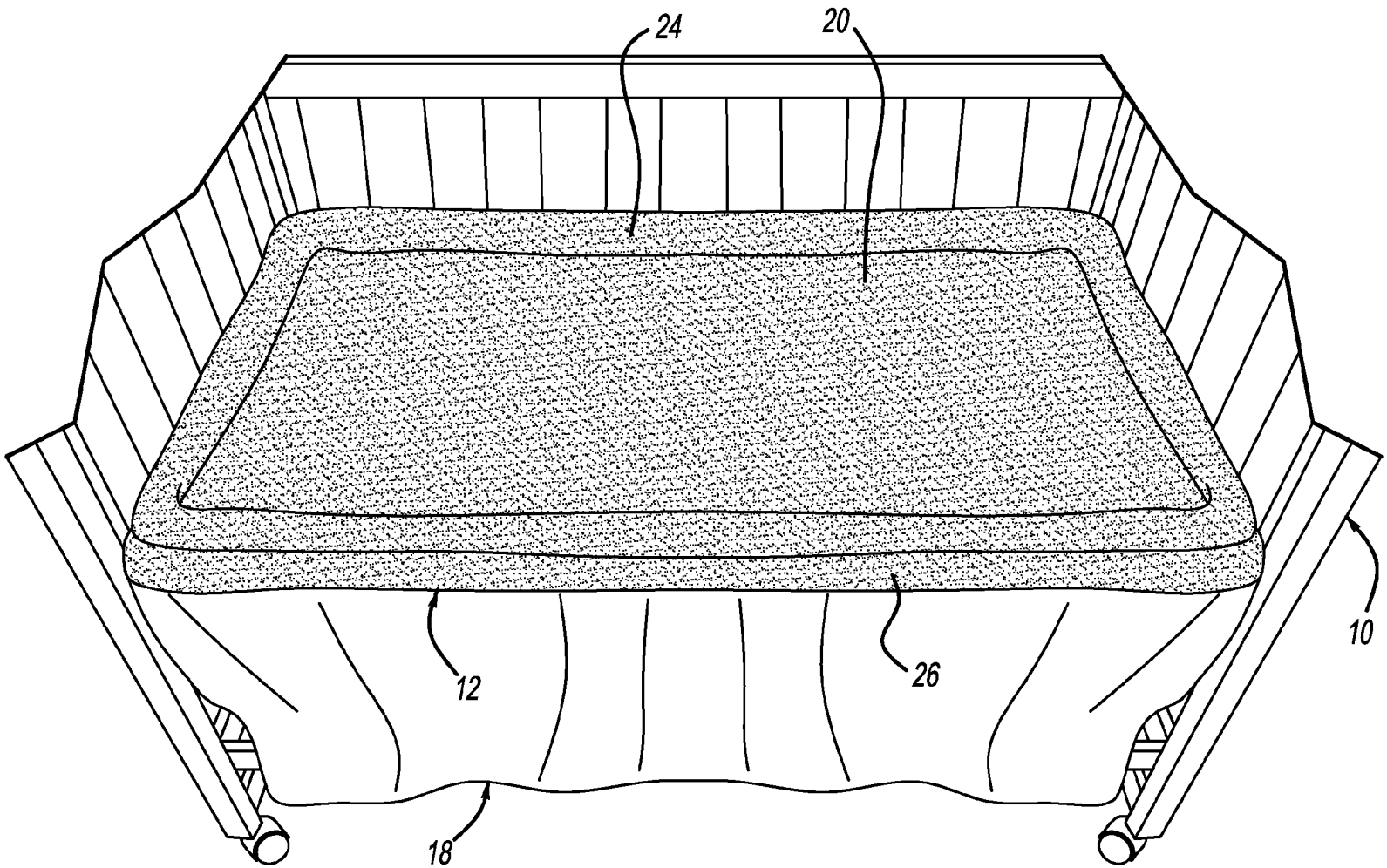
FIG. 5 is a partial perspective view of the crib with the crib skirt and a suspended cover attached to the bedding frame.

As shown in FIG. 5, the cover 12 may replace a traditional mattress structure and may include an upper layer 20, a lower layer 22 (FIG. 6), a cushioned trim 24, and a skirt 26. When employed in a standard crib 10, the cover 12 may have length and width dimensions of about fifty-one (51) by twenty-seven (27) inches (1295.4 millimeters by 685.8 millimeters), for example. In other configurations, the cover may have length and width dimensions of about fifty-three and one half (53.5) inches by about thirty (30) inches (1359 millimeters by 762 millimeters), for example. It will be appreciated that the cover 12 could include any other length and width dimensions suitable for bedding used by children.

The upper layer 20 may be formed from a "spacer" fabric including fluid-wicking yarns or fibers that are warp-knitted in an open-weave fashion. The upper layer 20 may be a knitted mesh including sinusoidal mesh strands extending generally parallel to each other. The strands are spaced apart from each other and connected to each other via a plurality of threads or a plurality of groups of threads that are spaced apart from each other. In this manner, the strands and threads of the fabric of the upper layer 20 cooperate to form a mesh having a plurality of polygonal, circular or oval-shaped holes. The upper layer 20 is permeable to fluids, dissipates heat and facilitates airflow therethrough. Preferably, the spacer fabric will include a top panel in contact with the child, formed from micro-denier fibers, a bottom panel which supports the top panel and a "spacer" upon which sticks the top and bottom panels together to form a three dimension fabric. An example of a suitable micro denier fiber would be spun polyester fibers having an average denier of 70 or more. Examples of suitable "spacer" fabric include a three-dimensional knit spacer fabric marketed under the brand name $D^3$ manufactured by Gehring Textiles, Inc. in Garden City, N.Y. Another suitable material for the upper layer 20 is marketed under the name 3MESH manufactured by Muller Textil located in Germany. In some configurations, the upper layer 20 may be one hundred percent monofilament polyester that may be fire resistant, mildew resistant, and resistant to alkaloids and acids. Other materials and fabrics may be used that allow air to relatively easily and passively flow through the upper layer 20 and are capable of performing the functionality described herein.

The lower layer 22 may be formed from a spacer fabric or a breathable polyester netting, for example, that may be substantially inelastic and dimensionally stable such that the lower layer has little or no stretch when placed under tension loads. A stitched joint may connect the lower layer 22 to the upper layer 20, generally along respective edges thereof, thereby forming a gap between the upper layer 20 and the lower layer 22.

As shown in FIG. 3, the lower layer 22 may include first and second panels forming a pocket that may be opened and closed with a flat coil zipper 36 or other closure. The lower layer may also include a first relief or cutout 38 at opposing ends of the zipper 36 and an opening 40 providing clearance for a latching mechanism, as will be subsequently described.

The cushioned trim 24 may be an elongated member extending around a perimeter of the cover 12. The cushioned trim 24 may be sized and positioned relative to the upper and lower layers 20, 22 to provide a barrier and cushion over the bedding frame 14 to protect a child lying in the crib 10. The cushioned trim 24 may include a fabric outer layer encasing a filler material to form a generally circular cross section, for example. By way of non-limiting example, the cushioned trim 24 may include a diameter of about one and one half (1.5)—two and one half (2.5) inches (38-64 millimeters). The outer layer may be formed from the breathable spacer fabric described above, for example, and may be connected to the upper and lower layers 20, 22 at a stitched joint. The filler material may be a resiliently compressible material. One example includes a six-layer polyester filler material manufactured by Petco Sackner and sold under the product designation jute braided polyester. Of course, other suitable cushioning material will work. It will be appreciated that the structure of the cushioned trim 24 is not limited to the structure described above, and may include alternatively configured dimensions and/or materials.

The skirt 26 may extend downward (relative to the view shown in FIGS. 5 and 6) from the stitched joint connecting the upper layer 20, the lower layer 22, and the cushioned trim 24. The skirt 26 may be formed from excess material of the upper layer 20, the lower layer 22, and the cushioned trim 24. The skirt 26 may be configured to conceal gaps between the cover 12 and the frame 14. The length and configuration of the skirt 26 may be formed in any suitable manner to facilitate the particular aesthetic and/or performance objectives of the bedding apparatus.

As shown in FIGS. 1 and 2, the bedding frame 14 may include a base 42, a plurality of adjustment linkages 44 and first and second rods 60, 62. The base 42 may include a generally rectangular frame including inner walls 50 (FIG. 1) defining an opening 52. The base 42 may be formed from metallic tubing, for example, or polymeric or wooden members. The inner walls 50 may include a plurality of spaced apart hooks 53 that support the liquid containment member 16, as shown in FIG. 2. Topsides 54 of the base 42 may include female latch members 58 (FIG. 6) that removably engage corresponding ones of the first and second rods 60, 62, as will be subsequently described.

The adjustment linkages 44 may be attached to the inner walls 50 and rail members 56 fixed to the crib 10. The adjustment linkages 44 may be adjustable among a plurality of positions to adjust the height of the base 42 relative to the rail members 56 of the crib 10.

Figure 6:
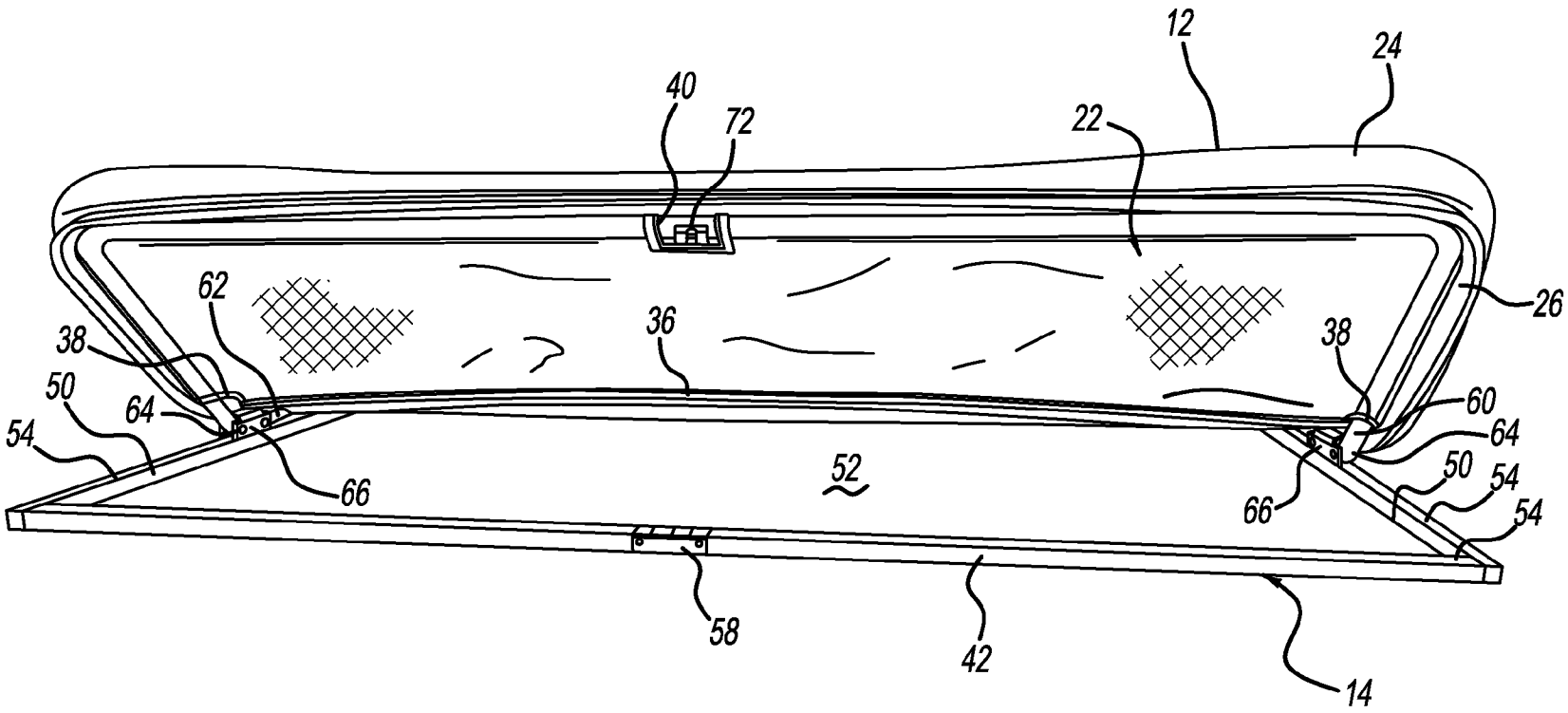
FIG. 6 is a partial perspective view of the frame and suspended cover in an open position.

The first and second rods 60, 62 may be generally U-shaped members and may be pivotable relative the base 42. Corresponding distal ends 64 of the first and second rods 60, 62 are connected to each other and to the base 42 via hinge assemblies 66 fixed to the topsides 54 of the base 42. The first and second rods 60, 62 may be formed from tubular aluminum or steel, for example, or any other metallic, wooden, polymeric or composite material having sufficient strength and rigidity. For example, the first and second rods 60, 62 may be formed from 0.75 inch (19 millimeter) outer diameter steel or aluminum. The first and second rods 60, 62 may extend through the cutouts 38 in the lower layer 22 of the cover 12 and may be received in the pocket formed in the lower layer 22 of the cover 12 (as shown in FIG. 6). The first and second rods 60, 62 may cooperate to form a tensioning device to maintain the cover 12 in a relatively taught condition when the first and second rods 60, 62 are in the closed position (shown in FIG. 5).

The hinge assemblies 66 allow the first and second rods 60, 62 to pivot between folded or open positions (shown in FIG. 6) and extended or closed positions (shown in FIG. 5). The first and second rods 60, 62 may pivot relative to each other and/or the base 42 of the frame 14 simultaneously or independently from each other. In some embodiments, the hinge assemblies 66 may include springs or other biasing members to urge the first and second rods 60, 62 toward the open positions.

Male latch members 72 (FIGS. 4 and 6) may be mounted to the first and second rods 60, 62, and may protrude through the openings 40 in the lower layer 22 of the cover 12, as shown in FIG. 6. The male latch members 72 may removably engage the female latch members 58 of the base 42 via a spring-loaded snap-fit, for example. A user may release the engagement between the male and female latch members 72, 58 by exerting a sufficiently strong upward force on the first and second rods 60, 62 relative to the base 42. It will be appreciated that any type of latch mechanism, clasp, or closure could be provided to selectively allow and prevent movement of the first and/or second rods 60, 62 relative to the base 42.

As shown in FIG. 2, the liquid containment member 16 may include sidewalls 80 and a bottom wall 82. The sidewalls 80 may include a plurality of spaced apart eyelets 83 that engage the hooks 53 of the base 42 such that the liquid containment member 16 may hang down from the base 42 in the opening 52. The sidewalls 80 may also include a mesh portion 84 that allows airflow through the sidewalls 80 in and out of the liquid containment member 16. The bottom wall 82 and lower portions 86 of the sidewalls 80 may be formed from a liquid-impermeable fabric or polymer, for example, that may hold liquid without the liquid soaking through.

Figure 4:
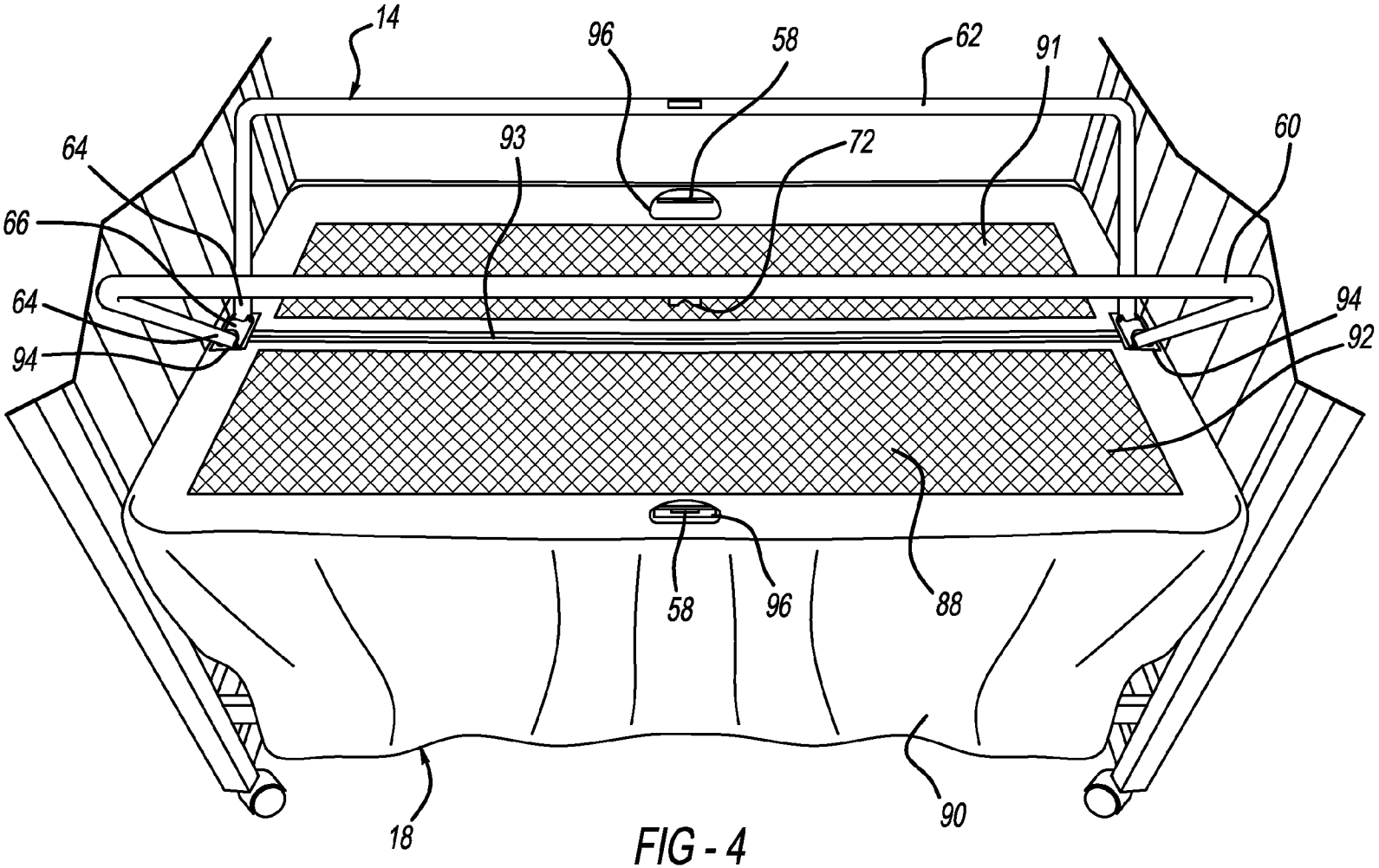
FIG. 4 is a partial perspective view of the crib and frame with the crib skirt attached to the frame.

As shown in FIGS. 3 and 4, the crib skirt 18 may include mesh top portion 88 and side portions 90 hanging down therefrom. The top portion 88 may be supported by the base 42 and may include first and second panels 91, 92 connected by a zipper 93 to allow for easy installation of the crib skirt onto the frame 14 and easy removal from the frame 14. The top portion 88 may include a pair of first openings 94 through which the first and second rods 60, 62 may extend, as shown in FIG. 4. The top portion 88 may also include a pair of second openings 96 that provide access to the female latch members 58 in the base 42 and allow the male latch member 72 to extend therethrough to engage the female latch members 58. The first and second panels 91, 92 of the top portion 88 may be formed from a mesh fabric material, for example, that allows for liquid to freely pass therethrough and collect in the liquid containment member 16 below the top portion 88. In some embodiments, the side portions 90 may include decorative patterns and/or colors, for example, and may act as an aesthetic accessory for the crib 10.

As shown in FIG. 5, when the cover 12 is in the taught condition (i.e., when the first and second rods 60, 62 are in the closed position), the cover 12 is disposed over and covers the top portion 88 of the crib skirt 18. In this manner, bodily fluids (e.g., saliva, urine, etc.) that a child may discharge while lying on the cover 12 may flow through the breathable material of the cover 12, flow through the mesh material of the top portion 88 of the crib skirt 18 and collect on the bottom wall 82 of the liquid containment member 16 until a parent or caregiver can empty and/or clean the liquid containment member 16. The breathable material of the cover 12, the mesh material of the top portion of the crib skirt, and the mesh material of the sidewalls 80 of the liquid containment member 16 provide a flow path for fresh air and breath exhaled from the child so that the child does not rebreathe a significant amount of carbon dioxide that he or she exhales while sleeping or otherwise laying on the cover 12.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A bedding apparatus comprising:

a frame including first and second members coupled to a base for pivotable motion relative thereto between first and second positions, the base defining an opening at least partially surrounded by the first and second members when the first and second members are in the first position;

a fabric cover coupled to the first and second members and maintained in a taught condition by the first and second members when the first and second members are in the first position; and a liquid containment member disposed below the cover and including sidewalls and a bottom wall attached to the sidewalls, the sidewalls attached to the base and extending through the opening, the sidewalls including mesh material allowing fluid-flow therethrough, the bottom wall including a liquid-impermeable material.

2. The bedding apparatus of claim 1, wherein the liquid containment member includes a plurality of eyelets engaging a plurality of hooks extending from sidewalls of the base.

3. The bedding apparatus of claim 1, wherein the cover includes a breathable fabric material allowing fluid-flow therethrough.

4. The bedding apparatus of claim 1, wherein the first and second members and the base include latch members releasably securing the first and second members in the first position.

5. The bedding apparatus of claim 1, further comprising a crib skirt including a top portion disposed on the frame and sidewalls hanging down from the top portion.

6. The bedding apparatus of claim 5, wherein the top portion includes first and second panels connected to each other by a zipper.

7. The bedding apparatus of claim 5, wherein the top portion includes a mesh material that allows fluid-flow therethrough.

8. The bedding apparatus of claim 6, further comprising an air-flow path extending through the sidewalls of the liquid containment member, the top portion of the crib skirt, and the cover.

9. The bedding apparatus of claim 1, wherein a periphery of the cover includes a resiliently compressible cushioned trim.

10. The bedding apparatus of claim 1, wherein the cover is in a slack condition when at least one of the first and second members is in the second position.

11. The bedding apparatus of claim 1, wherein the liquid containment member forms a receptacle for bodily fluids transmitted through the cover.

12. The bedding apparatus of claim 1, wherein the frame is mounted to and disposed within a crib.

13. The bedding apparatus of claim 12, wherein the base is attached to a rail member of the crib by a plurality of movable linkages.

14. A bedding apparatus comprising:

a crib;

a frame mounted within the crib and including a base defining an opening;

a fabric cover coupled to the frame and maintained in a taught condition by the frame; and a liquid containment member disposed below the cover and including sidewalls and a bottom wall attached to the sidewalls, the sidewalls attached to the base and extending through the opening, the sidewalls including mesh material allowing fluid-flow therethrough, the bottom wall including a liquid-impermeable material, wherein the liquid containment member forms a receptacle for bodily fluids transmitted through the cover.

15. The bedding apparatus of claim 14, wherein the frame includes first and second members coupled to the base for pivotable motion relative thereto between first and second positions, the first and second members surrounding the opening when the first and second members are in the first position, and wherein the cover is maintained in the taught condition by the first and second members when the first and second members are in the first position, and wherein the cover is maintained in a slack condition when the first and second members are in the second position.

16. The bedding apparatus of claim 14, wherein the liquid containment member includes a plurality of eyelets engaging a plurality of hooks extending from sidewalls of the base.

17. The bedding apparatus of claim 14, wherein the cover includes a breathable fabric material allowing fluid-flow therethrough.

18. The bedding apparatus of claim 14, further comprising a crib skirt including a top portion disposed on the frame and sidewalls hanging down from the top portion.

19. The bedding apparatus of claim 18, wherein the top portion includes a mesh material that allows fluid-flow therethrough, and wherein an air-flow path extends through the sidewalls of the liquid containment member, the top portion of the crib skirt, and the cover.

20. The bedding apparatus of claim 14, wherein the base is attached to a rail member of the crib by a plurality of movable linkages.

* * * * *